US005592054A

United States Patent [19]

Nerone et al.

[11] Patent Number: 5,592,054

[45] Date of Patent: Jan. 7, 1997

[54] FLUORESCENT LAMP BALLAST WITH SELECTABLE POWER LEVELS

[75] Inventors: Louis R. Nerone, Brecksville; Edward E. Hammer, Mayfield Village; Maria Sanchez, Cleveland, all of Ohio

[73] Assignee: General Electric Company, Schenectady, N.Y.

[21] Appl. No.: 523,858

[22] Filed: Sep. 6, 1995

[51] Int. Cl.[6] ..... H05B 39/00

[52] U.S. Cl. ..... 315/105; 315/106; 315/107; 315/200 R; 315/209 R; 315/276; 315/224

[58] Field of Search ..... 315/94, 100, 101, 315/104, 106, 105, 107, 200 R, 209 R, 291, 276, 282, 224, 225

[56] References Cited

U.S. PATENT DOCUMENTS

| | | | |
|---|---|---|---|
| 4,928,038 | 5/1990 | Nerone | 315/209 R |
| 5,250,877 | 10/1993 | Fisher | 315/106 |
| 5,483,125 | 1/1996 | Kachmarik et al. | 315/106 |

*Primary Examiner*—Robert Pascal

*Assistant Examiner*—Haissa Philogene

*Attorney, Agent, or Firm*—George E. Hawranko

[57] ABSTRACT

Disclosed is a power-level selection circuit in combination with a lamp circuit including a fluorescent lamp having first and second cathodes with resistive-heating filaments each spaced at a respective end of a lamp tube; first and second power leads for respectively connecting the cathodes to an a.c. power source whose power can be selectively enabled and interrupted by a main power switch; and a ballast inductor in serial circuit with one of the power leads and including a plurality of filament-heating windings for supplying power to the cathodes. The power-level selection circuit is interposed between a first cathode and a filament-heating winding, and includes a power-receiving circuit coupled to the filament-heating winding to receive power therefrom. Further included is a filament-supply circuit for continuously supplying available power to the first cathode. A selectable-impedance circuit is serially coupled between the first power lead and the first cathode and is responsive to a predetermined duration of interruption of power from the a.c. source to the power leads for selecting a different impedance of the selectable-impedance circuit, thereby selecting a different power level of the lamp.

18 Claims, 3 Drawing Sheets

FLUORESCENT LAMP BALLAST WITH SELECTABLE POWER LEVELS

FIELD OF THE INVENTION

The present invention relates to fluorescent lamps and ballast circuits therefor, and, more particularly, to such lamps and ballast circuits in which the power level of the lamp can be selected by the user.

BACKGROUND OF THE INVENTION

Typical fluorescent lamps for interior office lighting, for instance, employ a fairly simple inductive ballast for regulating current flow through the lamps. The current flow is regulated to be at some constant, resulting in constant lamp power. The cathodes of such lamps are typically filament-heated, and thus are double-ended. The cathodes are designed to be continually heated as long as the lamps are conducting.

Fairly sophisticated ballast circuits have been designed to enable a user to change the current level, and hence, power level of the lamps. Such ballast circuits, however, in addition to being costly of themselves, require installation by skilled electricians, for instance. This adds to the cost of such circuits.

SUMMARY OF THE INVENTION

It is an object of the invention to provide ballast circuitry which may be used in conjunction with existing ballast circuitry to enable a user of a fluorescent lamp to select multiple power settings of the lamp.

A further object of the invention is to provide ballast circuitry that can be simply interposed between a filament-heating winding of existing ballast circuitry and the cathode of a lamp.

Another object of the invention is to provide ballast circuitry which, in a preferred form, does not require installation by a skilled personnel.

One embodiment of the invention provides a power-level selection circuit in combination with a lamp circuit including a fluorescent lamp having first and second cathodes with resistive-heating filaments each spaced at a respective end of a lamp tube; first and second power leads for respectively connecting the cathodes to an a.c. power source whose power can be selectively enabled and interrupted by a main power switch; and a ballast inductor in serial circuit with one of the power leads and including a plurality of filament-heating windings for supplying power to the cathodes. The power-level selection circuit is interposed between a first cathode and a filament-heating winding.

The power-level selection circuit includes a power-receiving circuit coupled to the filament-heating winding to receive power therefrom. Further included is a filament-supply circuit for continuously supplying available power to the first cathode. A selectable-impedance circuit is serially coupled between the first power lead and the first cathode and is responsive to a predetermined duration of interruption of power from the a.c. source to the power leads for selecting a different impedance of the selectable-impedance circuit, thereby selecting a different power level of the lamp.

BRIEF DESCRIPTION OF THE DRAWING FIGURES

The foregoing, and further, objects and advantages of the invention will become apparent from the following description when read in conjunction with the drawing, in which:

FIG. 1A is a detail view of power-selection circuit 24 of FIG. 1, shown in block form, and housed within a sleeve at the end of a fluorescent lamp.

FIG. 1B is a detail schematic view of transformer $T_2$ of FIG. 1.

FIG. 1C is a detail view of an alternative circuit between nodes 36A and 36B of FIG. 1, showing an additional fluorescent lamp 12' serially connected to lamp 12 of FIG. 1.

FIG. 2A is a view of a B-H loop curve for transformer windings $T_{2A}$ and $T_{2B}$ shown in FIG. 2.

DETAILED DESCRIPTION OF THE PREFERRED EMBODIMENTS

Figure 1:
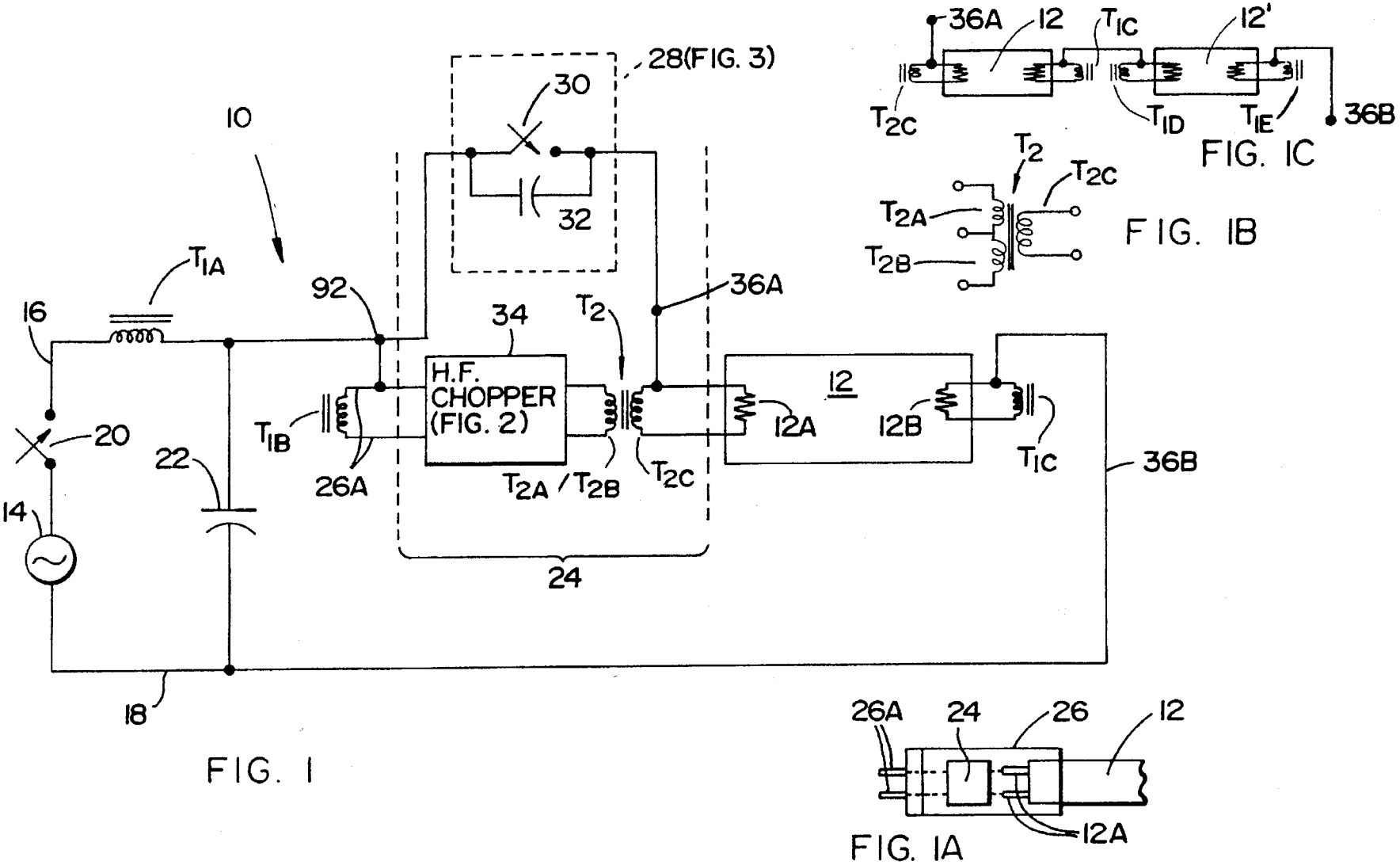
FIG. 1 is a schematic diagram of a fluorescent lamp and its ballast circuit in accordance with an embodiment of the invention.

FIG. 1 shows a circuit 10 including a fluorescent lamp 12 and ballast circuitry for supplying power to the lamp from an a.c. power source 14. Power leads 16 and 18 are connected to receive power from source 14, and supply such power to lamp 12. A main power switch 20, such as a common wall switch, is interposed in power lead 16; switch 20 enables, or interrupts, power to the lamp depending on its switching state (i.e., on or off).

A ballast inductor $T_{1A}$ and ballast capacitor 22 condition current that is supplied to lamp 12 in a known manner per se. Other ballast inductor arrangements will be apparent to those of ordinary skill in the art, such as one comprising an auto-transformer ballast inductor (not shown). Coupled to ballast inductor $T_{1A}$ are filament-heating windings $T_{1B}$ and $T_{1C}$ for supplying power to filament-heated cathodes 12A and 12B of the lamp, respectively. Windings $T_{1B}$ and $T_{1C}$ are intended to continually supply filament-heating power to the lamp cathodes so long as main switch 20 enables lamp power to be supplied from power source 14.

In a prior art configuration (not shown), filament winding $T_{1B}$ would be directly coupled across cathode 12A of the lamp; that is, in the same manner as filament winding $T_{1C}$ is coupled across cathode 12B of the lamp. However, interposed between filament winding $T_{1B}$ and cathode 12A is a power-level selection circuit 24 in accordance with the present invention. As will be described below, power-level selection circuit 24 permits a user of the lamp to select from different power levels of the lamp through manipulation of main power switch 20.

Circuit 24 is self-contained between filament winding $T_{1B}$ and cathode 12A; that is, it does not require connection to additional circuitry other than filament winding $T_{1B}$ and cathode 12A. As a result, as shown in FIG. 1A, such power-level selection circuit 24 may be conveniently packaged in a sleeve arrangement 26 fitting over the left-shown end of a shorter-than-standard fluorescent lamp 12, so that the resulting lamp length is standard. Sleeve arrangement 26 is preferably adhered to one end of lamp 12. The so-modified lamp 12 can then be installed in an existing fixture without changing the pre-existing ballast circuitry. Terminals 26A of sleeve arrangement 26 are adapted to be coupled across filament winding $T_{1B}$ as shown in FIG. 1; with double-ended (i.e. filament-heated) cathode 12A being coupled to circuit 24, shown in block form. The couplings from circuit 24 to sleeve terminals 26A, and from circuit 24 to cathode 12A, are shown as horizontal dashed lines. Of course, power-level selection circuit 24 can be housed in other manners, such as in a lamp fixture along with other ballast circuitry for the lamp.

Referring again to FIG. 1, power-level selection circuit 24 performs two separate functions. On the one hand, it includes a selectable-impedance circuit 28 that is serially coupled between power lead 16 and lamp cathode 12A. In general overview, with schematically shown switch 30 initially closed while the lamp is being powered, lamp current is at a maximum because the impedance through switch 30 is very low. A user then turns off main power switch 20 for a predetermined duration (e.g., "off-time"), and then turns it back on. (The off-time is typically between one second and one minute.) As will be explained in detail with respect to FIG. 3 below, switch 30 is responsive to the mentioned off-time of main power switch 20 and toggles into an open condition. This places an arrangement which includes a capacitor 32 and shunting switch 30, in serial circuit with the power supply for lamp 12, rather than low impedance switch 30. The power of the lamp accordingly decreases to a lower level. If a user then turns off main power switch 20 for another off-time of predetermined duration, typically also between one second and one minute, switch 30 toggles back into a conducting, low impedance condition.

A second function performed by power-level selection circuit 24 is continually supplying power to cathode 12A of lamp 12 while the lamp is powered from source 14. This is necessary to maintain the resistive-heating function of cathode 12A, to assure proper lamp operation and rapid starting of the lamp should it be momentarily turned off. Fulfilling this function is a high frequency (HF) chopper circuit 34, which derives power from filament winding $T_{1B}$, and supplies power to cathode 12A via a transformer $T_2$. Transformer $T_2$ includes two primary windings $T_{2A}$ and $T_{2B}$, such as shown in more detail in FIG. 1B. HF chopper circuit 34 is described more fully in connection with FIG. 2 below.

FIG. 1C shows a further fluorescent lamp 12' in addition to lamp 12, connected in series with lamp 12 between nodes 36A and 36B. Such circuit can replace the circuit between nodes 36A and 36B in FIG. 1, and result in similar power level control of lamp 12'. This is because the current through serially connected lamp 12' is the same as current through selectable-impedance circuit 28. Lamp 12' would have filament winding $T_{1D}$ and $T_{1E}$ corresponding to the filament windings $T_{1B}$ and $T_{1C}$ of lamp 12. Further lamps (not shown) serially connected to lamp 12 could also be used.

Figure 2:
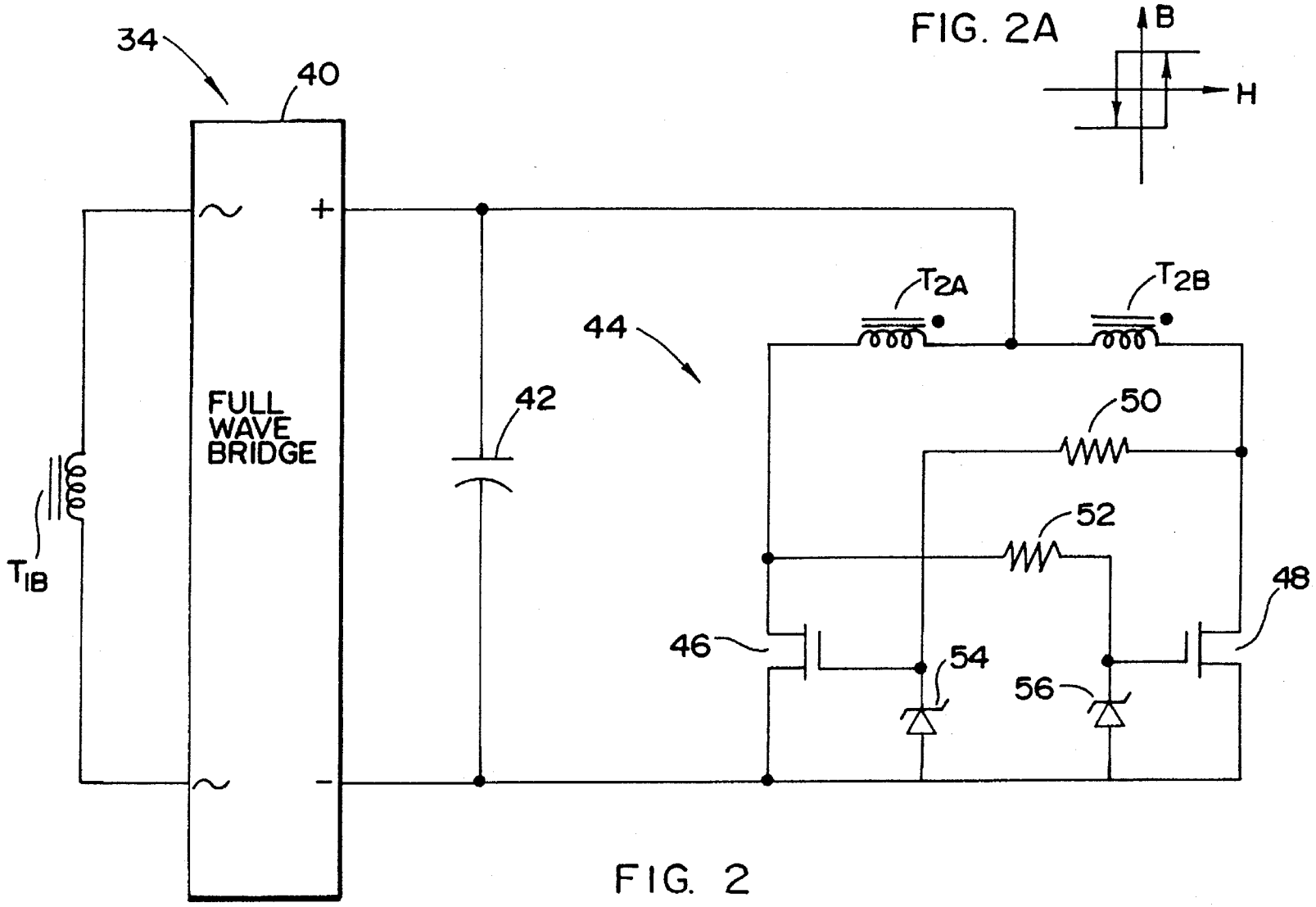
FIG. 2 is a schematic diagram, partially in block, of a preferred implementation of high frequency chopper circuit 34 of FIG. 1.
Figure 3:
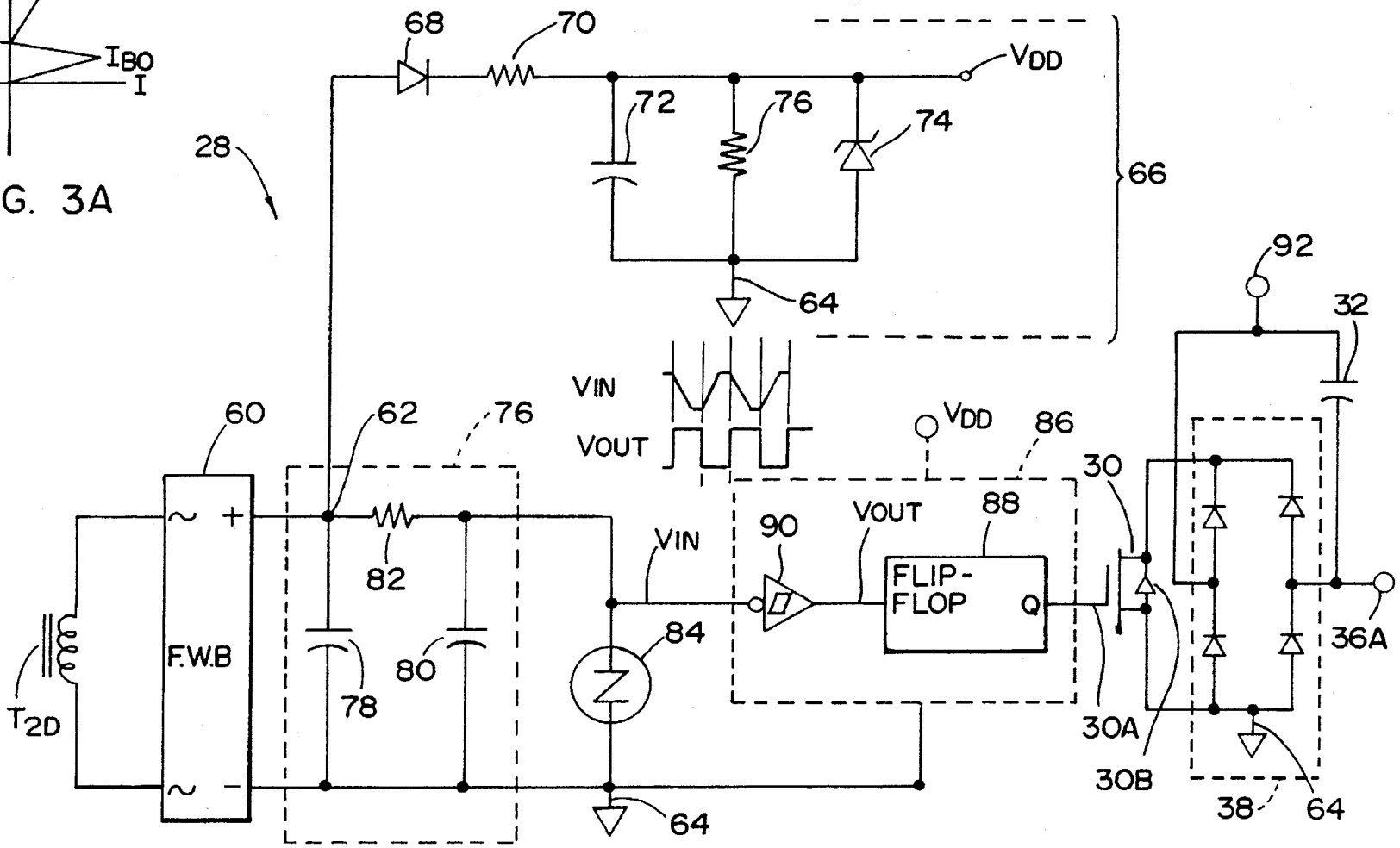
FIG. 3 is a schematic circuit, partially in block, for implementing a preferred form of selectable-impedance circuit 28 of FIG. 1.

FIG. 2 shows an implementation of high frequency (HF) chopper circuit 34, as connected to filament winding $T_{1B}$, shown also in FIG. 1. The a.c. current supplied by winding $T_{1B}$ is rectified by a full-wave bridge 40 and filtered by a capacitor 42 so as to provide d.c. current to an oscillator 44, such as a Royer oscillator, whose operation per se is known in the art. Oscillator 44 includes transformer windings $T_{2A}$ and $T_{2B}$ as shown in FIG. 2, winding $T_{2C}$ as shown in FIG. 1, and $T_{2D}$ as shown in FIG. 3. These windings are formed from a combination of metal and glass, and exhibit a square B-H loop curve as shown in simplified form in FIG. 2A.

In oscillator 44, MOSFETs 46 and 48 are caused to alternatively conduct, and hence cause alternate current flow through respective windings $T_{2A}$ and $T_{2B}$. Such conduction through these windings causes conduction in coupled winding $T_{2C}$, shown in FIG. 1, for supplying filament-heating power to cathode 12A. MOSFETs 46 and 48 are respectively controlled by biasing circuits including resistors 50 and 52, and Zener diodes 54 and 56. Selection of values for the foregoing components will cause alternate switching at a desired frequency, such as at 50 kilohertz where the frequency of source 14 (FIG. 1) is 60 hertz. By having the frequency of operation of transformer $T_2$ sufficiently different from the frequency of source 14, any parasitic (e.g., capacitive) coupling at the source 14 frequency between HF chopper circuit 34 and winding $T_{2C}$ (FIG. 1) is negligible. Representative component values for oscillator 44 are specified below.

Referring now to FIG. 3, a schematic circuit for implementing a preferred form of selectable-impedance circuit 28 of FIG. 1 is shown. A full-wave bridge 60 rectifies current from transformer winding $T_{2D}$, providing a d.c. voltage between node 62 and reference or ground 64 for circuit 28. (Ground 64 is shown in several locations in FIG. 3.) Power supply circuit 66, which provides power on a node labeled $V_{DD}$, is first described. $V_{DD}$ represents voltage used to operate further components of selectable-impedance circuit 28, as will be described below.

After flowing from node 62, rectified current from bridge 60 passes through p-n diode 68 and resistor 70 to charge capacitor 72 to a desired voltage ($V_{DD}$) limited by the voltage rating of Zener diode 74. Capacitor 72 is allowed to discharge through a resistor 76, with a time constant that is relatively high compared with a time constant described below for operation of the remainder of circuit 28.

Figure 3A:
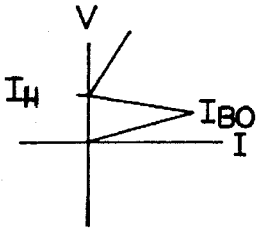
FIG. 3A shows an voltage-versus-current switching characteristic of a preferred switch 84 for use in the circuit of FIG. 3.

Considering the remainder of circuit 28, a low pass filter 76 is formed from capacitors 78 and 80, together with resistor 82. Filter 76 provides current to a switching device 84, such as a Silicon Bilateral Switch (SBS), e.g., a Part No. MBS4992 switch made by Motorola of Phoenix, Arizona. It is preferred that the breakover voltage of switch 84 be less than the maximum voltage of $V_{DD}$ of power supply circuit 66 as set by Zener diode 74. An SBS has a desirable switching characteristic as shown in FIG. 3A, where the holding current $I_H$ of the device (e.g., 200–300 microamps) is not much greater than the breakover current $I_{BO}$ of the $I_{BO}$ device (e.g., 100 microamps). The upper electrode of switch 84 is connected via intermediate circuitry 86 to gate 30A of switching device 30.

Device 30 and capacitor 32, which shunts device 30, correspond to the like-numbered switch and capacitor is FIG. 1. Because an intrinsic diode 30B of a MOSFET switch 30 will not block current in the reverse direction, a full-wave bridge 38 is used to provide direct current to switch 30 from nodes 36A and 92 only in the forward direction. The circuitry in FIG. 3 between nodes 36A and 92 implements the circuity for selectable-impedance circuit 28 of FIG. 1 connected between nodes 36A and 92.

Intermediate circuitry 86 assures that the voltage at gate 30A remains steady until switching device 84 changes state. Circuitry 80 may comprise the first-stage, positive edge-triggered flip-flop 88 and negative edge-triggered Schmitt input 90 (with hysteresis) of a standard CMOS, N-stage ripple MC 14020B chip sold by above-mentioned Motorola.

Input and output voltages of Schmitt input 90 are shown in FIG. 3 as voltages $V_{IN}$ and $V_{OUT}$, respectively. As shown, $V_{IN}$ goes positive as $V_{OUT}$ goes negative, and vice-versa. Accordingly, when power is applied to input winding $T_{2D}$, i.e., when main power switch 20 (FIG. 1) is turned on, the positive-going voltage $V_{IN}$ has no effect on Schmitt input 90. Only when the current in switching device 84 falls below holding current $I_H$ of the device (FIG. 3A), does input voltage $V_{IN}$ have a negative-going value; this causes Schmitt input 90 to provide a positive output, in turn causing positive edge-triggered flip-flop 88 to change states and switch 30 to change states.

The values of the components of low pass filter 76 determine the time constant for reducing current supplied to switch 84 when power from source 14 (FIG. 1) is interrupted by a user opening main power switch 20. Such values are chosen to result in current to switch 84 falling below its holding current $I_H$ within a predetermined duration, which may be conveniently above about one second. On the other hand, the main power switch needs to be switched on before capacitor 72 of power supply circuit 66 falls below the minimum $V_{DD}$ supply level for circuitry 86. The time constant for discharge of capacitor 72 may be chosen to allow about one minute of off-time for the main power switch before too low a $V_{DD}$ supply is reached. Accordingly, a user can effect a change of impedance of selectable-impedance circuit 28 of FIG. 3 by turning off the main power switch for more than, e.g., one second and less than, e.g., one minute. To again change the impedance of selectable-impedance circuit 28, the user repeats the turn off of the main power switch for a duration, again, of more than, e.g., one second, and less than, e.g., one minute.

In an exemplary embodiment of the invention, in addition to details supplied above, circuit values for a pair of serially connected fluorescent lamps (FIG. 1C) rated up to 40 watts each, and with an a.c. source voltage of 120 volts r.m.s., are as follows: Windings $T_{2A}$ and $T_{2B}$ (e.g., FIG. 1B), 6 turns each; winding $T_{2C}$, 12 turns; filter capacitor 42 (FIG. 2), 220 microfarads; resistors 50 and 52, 100 ohms each; Zener diodes 54 and 56, rated at 5.1 volts; MOSFETs 46 and 48, model IRF7102 MOSFETs sold by International Rectifier Company of El Segundo, Calif.; capacitor 78 (FIG. 3), 22 microfarads; resistor 82, 10 k ohms; capacitor 80, 0.01 microfarads; SBS switch 84, breakover rating at 8 volts such as sold under product designation MBS4992 by above-mentioned Motorola; switch 30, a model IRFR420 MOSFET sold by above-mentioned International Rectifier Company; shunting capacitor 32, 0.47 microfarads; resistor 70, 100 k ohms; capacitor 72, 100 microfarads; resistor 76, 1 megohm; and Zener diode 74, rated at 10 volts.

While the invention has been described with respect to specific embodiments by way of illustration, many modifications and changes will occur to those skilled in the art. For instance, while selectable-impedance circuit 28 has been shown with a single-pole switch 30 with a single capacitor 32 shunting the switch, the use of multiple and/or more sophisticated (e.g., double or triple throw) switches and multiple capacitors is contemplated. This would allow selectable-impedance circuit 28 to selectively interpose a nil impedance or any of a plurality of capacitive impedances, all accessible in the above-mentioned manner of interrupting power to the lamp for a predetermined duration. Each different impedance would result in a different power level in the lamp(s). It is, therefore, to be understood that the appended claims are intended to cover all such modifications and changes as fall within the true scope and spirit of the invention.

What is claimed is:

1. In combination with a lamp circuit including a fluorescent lamp having first and second cathodes with resistive-heating filaments each spaced at a respective end of a lamp tube; first and second power leads for respectively connecting said cathodes to an a.c. power source whose power can be selectively enabled and interrupted by a main power switch; and a ballast inductor being in serial circuit with one of said power leads and including a plurality of filament-heating windings for supplying power to said cathodes; a power-level selection circuit interposed between a first cathode and a filament-heating winding, comprising:

(a) a power-receiving circuit coupled to said filament-heating winding to receive power therefrom;

(b) a filament-supply circuit for continuously supplying available power to said first cathode; and (c) a selectable-impedance circuit serially coupled between said first power lead and said first cathode and being responsive to a predetermined duration of interruption of power from said a.c. source to said power leads for selecting a different impedance of said selectable-impedance circuit, thereby selecting a different power level of said lamp.

2. The combination of claim 1, wherein said selectable-impedance circuit is responsive to a further predetermined duration of interruption of power from said a.c. source to said power leads for selecting a further impedance of said selectable-impedance circuit, so as to select a different power level of said lamp.

3. The combination of claim 1, wherein said filament-supply circuit includes:

(a) a primary transformer winding; and (b) a secondary transformer winding coupled to receive power from said primary transformer winding and serially coupled to said first cathode to provide power thereto;

(c) said secondary and primary transformer windings being operated at a frequency at which any parasitic coupling therebetween is negligible at the frequency of said a.c. power source.

4. The combination of claim 3, wherein:

(a) said filament-supply circuit includes a further secondary winding coupled to receive power from said primary transformer winding;

(b) said further secondary winding supplying power to said selectable-impedance circuit.

5. The combination of claim 1, wherein said power-level selection circuit has a total of four electrical connections to external circuitry, two from said filament-heating winding, and two to said first cathode.

6. The combination of claim 1, wherein said power-level selection circuit is housed within a sleeve that fits over a cylindrical end of a fluorescent lamp.

7. In combination with a lamp circuit including a fluorescent lamp having first and second cathodes with resistive-heating filaments each spaced at a respective end of a lamp tube; first and second power leads for respectively connecting said cathodes to an a.c. power source whose power can be selectively enabled and interrupted by a main power switch; and a ballast inductor being in serial circuit with one of said power leads and including a plurality of filament-heating windings for supplying power to said cathodes; a power-level selection circuit interposed between a first cathode and a filament-heating winding, comprising:

(a) a power-receiving circuit coupled to said filament-heating winding to receive power therefrom;

(b) a filament-supply circuit for continuously supplying available power to said first cathode; and (c) a selectable-impedance circuit serially being coupled between said first power lead and said first cathode and being responsive to repeated, predetermined durations of interruption of power from said a.c. source to said power leads for toggling between a first and a second impedance of said selectable-impedance circuit, thereby providing two different power levels of said lamp.

8. The combination of claim 7, wherein said first and second impedances include a nil impedance.

9. The combination of claim 7, wherein said selectable-impedance circuit comprises:

(a) a first switch and a capacitor shunting said first switch, and coupled to said lamp to provide a low impedance and a higher impedance, respectively;

(b) a second switch that remains conductive so long as power is supplied to the lamp, and that becomes non-conductive after lamp power has been interrupted for a first predetermined period of time; and (c) circuitry for sensing when said second switch becomes non-conductive and responsively controlling said first switch to change its conduction state.

10. The combination of claim 9, wherein said filament-supply circuit includes:

(a) a primary transformer winding;

(b) a secondary transformer winding coupled to receive power from said primary transformer winding and serially coupled to said first cathode to provide power thereto; and (c) a further secondary winding coupled to receive power from said primary transformer winding;

(d) said further secondary winding supplying power to said selectable-impedance circuit.

11. The combination of claim 7, wherein said power-level selection circuit has a total of four electrical connections to external circuitry, two from said filament-heating winding, and two to said first cathode.

12. The combination of claim 11, wherein said power-level selection circuit is housed within a sleeve that fits over a cylindrical end of a fluorescent lamp.

13. For use in combination with a lamp circuit including a fluorescent lamp having first and second cathodes with resistive-heating filaments each spaced at a respective end of a lamp tube; first and second power leads for respectively connecting said cathodes to an a.c. power source whose power can be selectively enabled and interrupted by a main power switch; and a ballast inductor being in serial circuit with one of said power leads and including a plurality of filament-heating windings for supplying power to said cathodes; a power-level selection circuit interposed between a first cathode and a filament-heating winding, comprising:

(a) a power-receiving circuit coupled to said filament-heating winding to receive power therefrom;

(b) a filament-supply circuit for continuously supplying available power to said first cathode; and (c) a selectable-impedance circuit serially coupled between said first power lead and said first cathode and being responsive to a predetermined duration of interruption of power from said a.c. source to said power leads for selecting a different impedance of said selectable-impedance circuit, thereby selecting a different power level of said lamp.

14. The power-level selection circuit of claim 13, wherein said selectable-impedance circuit is responsive to a further predetermined duration of interruption of power from said a.c. source to said power leads for selecting a further impedance of said selectable-impedance circuit, so as to select a different power level of said lamp.

15. The power-level selection circuit of claim 13, wherein said filament-supply circuit includes:

(a) a primary transformer winding; and (b) a secondary transformer winding coupled to receive power from said primary transformer winding and serially coupled to said first cathode to provide power thereto;

(c) said secondary and primary transformer windings being operated at a frequency at which any parasitic coupling therebetween is negligible at the frequency of said a.c. power source.

16. The power-level selection circuit of claim 15, wherein:

(a) said filament-supply circuit includes a further secondary winding coupled to receive power from said primary transformer winding;

(b) said further secondary winding supplying power to said selectable-impedance circuit.

17. The power-level selection circuit of claim 13, wherein the total number f electrical connections to external circuitry from said power-level selection circuit is four, two being from said filament-heating winding, and two being to said first cathode.

18. The power-level selection circuit of claim 17, further comprising:

(a) a housing within which said power-level selection circuit is contained;

(b) said housing comprising a sleeve that fits over a cylindrical end of a fluorescent lamp.

* * * * *